US008382450B2

(12) United States Patent
Ida et al.

(10) Patent No.: US 8,382,450 B2
(45) Date of Patent: Feb. 26, 2013

(54) CENTRIFUGAL FAN

(75) Inventors: Kiyoto Ida, Kyoto (JP); Masashi Hirayama, Kyoto (JP); Hiroyoshi Teshima, Kyoto (JP)

(73) Assignee: Nidec Corporation, Kyoto (JP)

( * ) Notice: Subject to any disclaimer, the term of this patent is extended or adjusted under 35 U.S.C. 154(b) by 451 days.

(21) Appl. No.: 12/773,067

(22) Filed: May 4, 2010

(65) Prior Publication Data

US 2010/0303647 A1 Dec. 2, 2010

(30) Foreign Application Priority Data

May 29, 2009 (JP) ..... 2009-130657

(51) Int. Cl.
*F04B 35/04* (2006.01)
*H02K 11/00* (2006.01)

(52) U.S. Cl. ..... 417/354; 417/423.1; 417/423.14; 310/68 R

(58) Field of Classification Search ..... 417/354, 417/423.1, 423.14; 310/67 R, 58, 68 R
See application file for complete search history.

(56) References Cited

U.S. PATENT DOCUMENTS

| | | | | |
|---|---|---|---|---|
| 4,728,833 | A * | 3/1988 | Shiraki et al. | 310/68 R |
| 5,523,918 | A | 6/1996 | Chiou | |
| 6,394,768 | B1 | 5/2002 | Fukuda et al. | |
| 6,836,039 | B2 * | 12/2004 | Choi et al. | 310/81 |
| 2007/0194668 | A1 * | 8/2007 | Teshima et al. | 310/67 R |
| 2008/0223905 | A1 | 9/2008 | Horng et al. | |

FOREIGN PATENT DOCUMENTS

| | | | |
|---|---|---|---|
| JP | 63-63069 | U | 4/1988 |
| JP | 10-285872 | A | 10/1998 |
| JP | 11-234945 | A | 8/1999 |
| JP | 2000-201464 | A | 7/2000 |
| JP | 2001-241395 | A | 9/2001 |
| JP | 2007-218234 | A | 8/2007 |

* cited by examiner

*Primary Examiner* — Charles Freay
(74) *Attorney, Agent, or Firm* — Keating & Bennett, LLP

(57) ABSTRACT

A centrifugal fan includes a housing including a base, a side wall portion having an air outlet defined therein, and a cover arranged above the side wall portion and having an air inlet defined therein. A circuit board is arranged on an upper surface of the base, and includes a circuit board protruding portion arranged to protrude radially outward of the housing. At least one of electronic components to be mounted on the circuit board is arranged radially outward from an inner circumferential surface of the side wall portion.

20 Claims, 17 Drawing Sheets

CENTRIFUGAL FAN

BACKGROUND OF THE INVENTION

1. Field of the Invention

The present invention relates to an electric centrifugal fan used for air blowing.

2. Description of the Related Art

Conventionally, there have been two types of blower fans: axial fans and centrifugal fans. In general, the axial fans are excellent in air flow quantity characteristic, whereas the centrifugal fans are excellent in static pressure characteristic.

For the purpose of cooling an electronic device, such as a notebook computer, in which electronic components are densely packed, excellence in the static pressure characteristic tends to be demanded more than excellence in the air flow quantity characteristic. In particular, the centrifugal fan is commonly adopted for a small-sized blower fan used to cool the notebook computer.

The centrifugal fan includes an impeller portion arranged inside a housing thereof. The impeller portion includes a plurality of blades which are arranged on an outside surface of a covered cylindrical hub forming a portion of a motor. Air is taken in in an axial direction and blown out in a radial direction. The housing of the centrifugal fan typically includes a base, to which the motor is fixed; a side wall defining a flow path of air; and a cover arranged to cover an upper end of the side wall.

In small-sized centrifugal fans, excellence in the static pressure characteristic is often achieved at the sacrifice of the air flow quantity characteristic. Thus, an important technical issue is how to maintain a sufficient air flow quantity.

One conceivable way of maintaining a sufficient air flow quantity is reducing the diameter of the hub to increase air intake. A reduction in the diameter of the hub involves the need to reduce the size of a circuit board arranged below the hub. However, size reduction of electronic components to be mounted on the circuit board has a limit because of technological limitations, and the circuit board arranged below the hub may not have sufficient space for all the electronic components to be mounted thereon. Thus, an issue is how to secure sufficient space for the mounting of all the electronic components.

As such, in some centrifugal fans of a two-side intake type, in which air inlets are defined in both axial sides of the housing, a portion of the base-side air inlet is closed, a portion of the circuit board is arranged to extend over the closed portion, and some of the electronic components are arranged on this portion of the circuit board.

However, regarding the centrifugal fans of the two-side intake type, when a portion of the circuit board is arranged to extend radially outward of the area below the hub to overlap with a wind tunnel, this portion of the circuit board tends to present an obstacle in the flow path of air. Meanwhile, in the case of small-sized centrifugal fans of a one-side intake type, in which electronic components are arranged on an upper surface of that portion of the circuit board which is arranged axially opposite the impeller portion, the electronic components may have such a great axial height as to provide resistance against the flow of air, because of the small size of the centrifugal fans.

SUMMARY OF THE INVENTION

According to a preferred embodiment of the present invention, a centrifugal fan includes a hub substantially in the shape of a covered cylinder centered on a central axis; an impeller arranged radially outward of the hub; a magnet attached to an inside of the hub; an armature arranged radially opposite the magnet; a bearing mechanism arranged to support the hub such that the hub is arranged to rotate about the central axis with respect to the armature; a bearing housing arranged to support the bearing mechanism; a base arranged to support a lower end portion of the bearing housing; a side wall including an air outlet defined therein, and arranged radially outward of the impeller to surround the impeller; a cover including an air inlet defined therein, and arranged axially above the side wall; a housing including the base, the side wall, and the cover; a circuit board arranged on an upper surface of the base; and a control circuit portion including electronic components and arranged on the circuit board. The circuit board includes a protruding portion arranged to protrude radially outward of an outer surface of the side wall of the housing. At least one of the electronic components is arranged on the protruding portion.

A centrifugal fan having the above-described structure permits a minimum number of electronic components to be mounted within that area of the circuit board which is axially opposed to an outer circumferential surface of the hub substantially in the shape of a covered cylinder, with at least one of required electronic components mounted on the protruding portion of the circuit board, which is arranged radially outward of the outer surface of the side wall of the housing. Since some of the electronic components are arranged radially outward of a wind tunnel, that arrangement allows a reduction in the diameter of the hub while preventing the electronic components from significantly interfering with a flow of air in a flow path within the wind tunnel, and allows the fan to be excellent in static pressure characteristic and air flow quantity characteristic. Moreover, the arrangement of one or more electronic components radially outward of the outer surface of the side wall of the housing allows an increase in width of the wind tunnel, and also enables a design of a small-sized centrifugal fan regardless of the number or size of required electronic components.

According to a preferred embodiment of the present invention, a reduction in size of a centrifugal fan can be achieved by arranging one or more electronic components radially outward of the outer surface of the side wall of the housing.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

For convenience of explanation, it is assumed herein that an upward/downward direction is defined along a central axis J1, and that a side on which a cover of a housing is arranged and a side on which a base of the housing is arranged are referred to as an upper side and a lower side, respectively. Note, however, that in practical use the central axis J1 is not necessarily arranged along the direction of gravity.

First Preferred Embodiment

Figure 1:
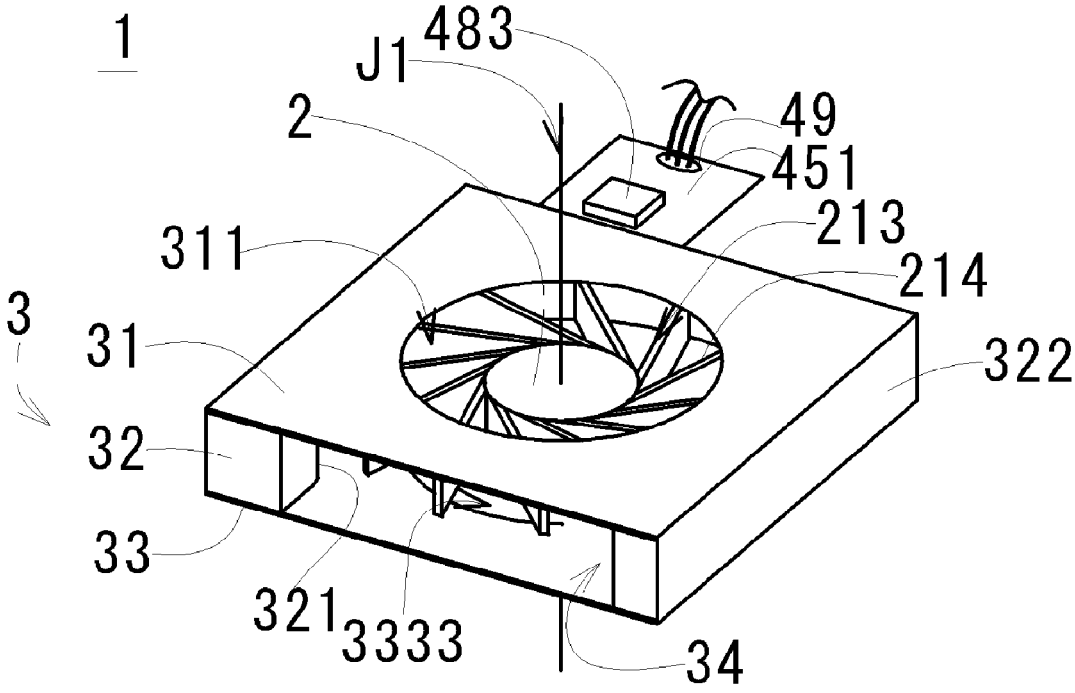
FIG. 1 is a perspective view of the exterior of a small-sized centrifugal fan 1 according to a first preferred embodiment of the present invention.
Figure 2:
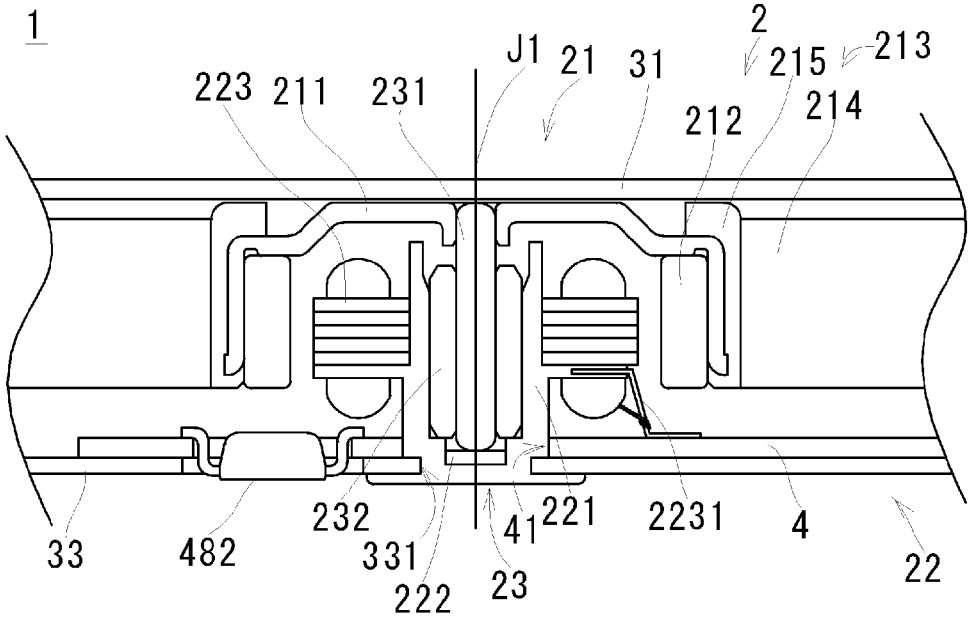
FIG. 2 is a vertical cross-sectional view of an internal structure of the centrifugal fan 1 according to the first preferred embodiment of the present invention.
Figure 4:
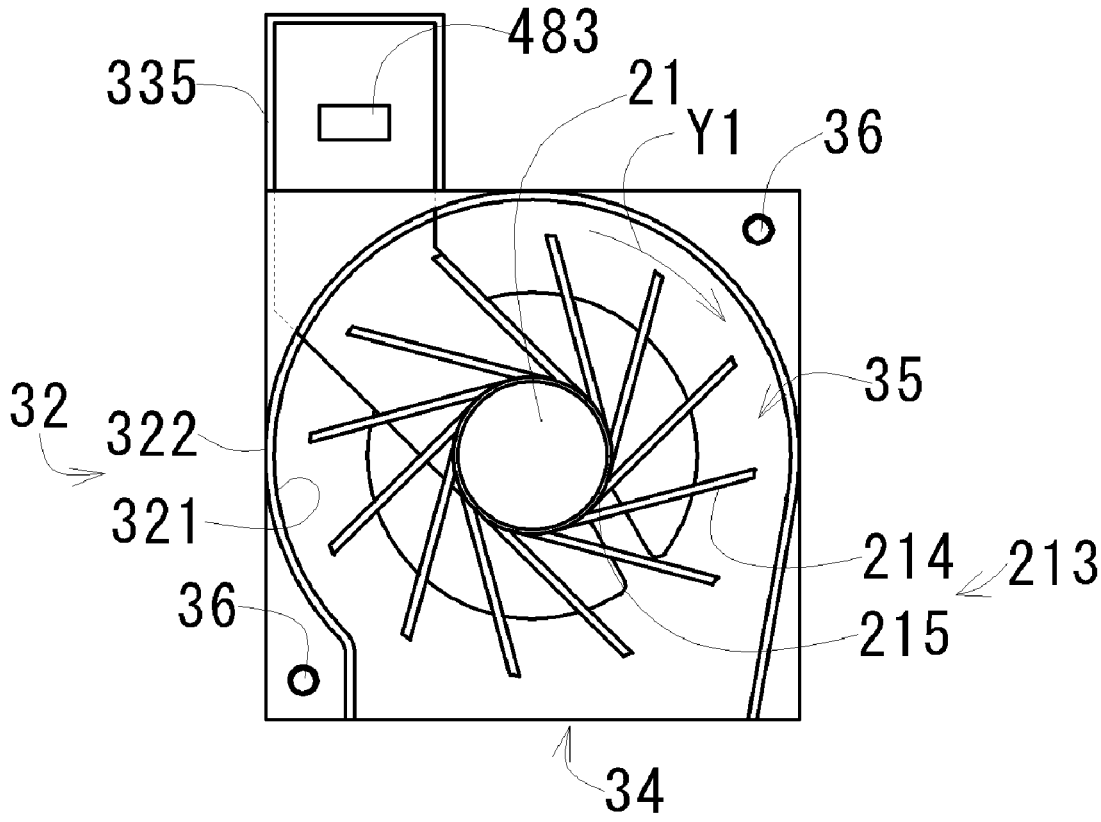
FIG. 4 is a plan view of the centrifugal fan 1 according to the first preferred embodiment of the present invention, with only the cover 31 of the housing 3 removed.

FIG. 1 is a perspective view of the exterior of a small-sized centrifugal fan 1 according to a first preferred embodiment of the present invention. FIG. 2 is a vertical cross-sectional view of an internal structure of the centrifugal fan 1. FIG. 4 is a plan view of the centrifugal fan 1, with only a cover 31 of a housing 3 removed. Note that details are simplified in FIGS. 2 and 4.

As illustrated in FIG. 1, the centrifugal fan 1 preferably includes an impeller 213, a motor portion 2 arranged to rotate about the predetermined central axis J1, and the housing 3 arranged to contain the motor portion 2. The housing 3 preferably is substantially in the shape of a rectangular parallelepiped, and has an opening 34 defined in one surface thereof. This opening 34 serves as an air outlet of the centrifugal fan 1 as described below, and will accordingly be hereinafter referred to as an "air outlet 34". The housing 3 further has a cover opening 311 defined in an upper surface (i.e., the cover 31) thereof. The cover opening 311 serves as an air inlet of the centrifugal fan 1.

As illustrated in FIG. 2, the motor portion 2 includes a rotor portion 21 and a stator portion 22. The rotor portion 21 is a rotating body, whereas the stator portion 22 is a stationary body. The rotor portion 21 is supported by a bearing mechanism 23 to be rotatable with respect to the stator portion 22. The rotor portion 21 preferably includes a hub 211 and the impeller 213. The hub 211 is substantially in the shape of a cylinder with a single covered end, with the central axis J1 at its center, and opens toward the stator portion 22 (i.e., downward in FIG. 2). The impeller 213 includes a plurality of blades 214 arranged on an outer circumferential surface of an impeller cup 215. The impeller cup 215 is preferably substantially in the shape of a cylinder, with the central axis J1 at its center. In the present preferred embodiment, the diameter of the hub 211 is preferably equal to or less than about 20 mm, for example. The hub 211 is inserted inside the impeller cup 215 and fixed thereto. The blades 214 are arranged radially outward of the hub 211 so as to assume the shape of a ring with the central axis J1 at its center. In the present preferred embodiment, a plain bearing is used as the bearing mechanism 23.

As illustrated in FIG. 2, a multi-polarized, annular field magnet 212 is preferably inserted inside the hub 211 from the opening side of the hub 211, and fixed to an inside surface of the hub 211. The hub 211 has an insert hole defined at the center of a cover portion thereof. A fixed end (i.e., an end on the rotor portion 21 side) of a shaft 231 of the bearing mechanism 23 is inserted in the insert hole, so that the shaft 231 is fixed to the hub 211.

As illustrated in FIG. 2, a free end of the shaft 231 is inserted inside a cylindrical sleeve 232 made of an oil-impregnated porous metal, for example, and the sleeve 232 is inserted inside a bearing housing 221 and fixed thereto. The bearing housing 221 is preferably substantially in the shape of a cylinder with a bottom. The shaft 231 and the sleeve 232 combine to define the bearing mechanism 23. The bearing housing 221 is attached to a base 33 of the housing 3. Therefore, the bearing mechanism 23 supports the hub 211 such that the hub 211 is rotatable about the central axis J1 with respect to the housing 3.

Note that the bearing mechanism 23 is not limited to the combination of the shaft 231 and the sleeve 232. For example, a ball bearing or the like, for example, may be used for the bearing mechanism in other preferred embodiments. On an inside bottom surface of the bearing housing 221, a thrust plate 222 is preferably provided at a position opposite to an end surface of the free end of the shaft 231. The thrust plate 222 is preferably made of a low-frictional synthetic resin material, for example, and arranged to support the shaft 231 in an axial direction.

An armature 223 is arranged to surround the bearing housing 221. Windings of the armature 223 are connected to a terminal 2231. The terminal 2231 is soldered to a circuit board 4. Thus, the armature 223, which is of a small size, is easily electrically connected to the circuit board 4. Note that the circuit board 4 may be, for example, a flexible circuit board (e.g., a flexible printed circuit (FPC)).

In the centrifugal fan 1, a current supplied from the circuit board 4 to the armature 223 is controlled to produce a torque (i.e., a turning force) centered on the central axis J1 between the field magnet 212 and the armature 223, which is arranged radially inward of (i.e., closer to the central axis J1 than) the field magnet 212. That is, the field magnet 212 and the armature 223 combine to define a drive mechanism. The impeller 213, which is fixed to the hub 211, is thus arranged to rotate in a predetermined direction together with the hub 211.

The housing 3 includes the base 33. The base 33 is preferably flat and extends perpendicularly or substantially perpendicularly to the central axis J1 (see FIG. 2). The circuit board 4 is fixed to an upper surface of the base 33, i.e., a surface of the base 33 facing the cover 31. The base 33 and the circuit board 4 have defined therein fixing holes 331 and 41, respectively, with the central axis J1 for their center. A lower end portion of the bearing housing 221 is inserted in the fixing holes 331 and 41.

Figure 3:
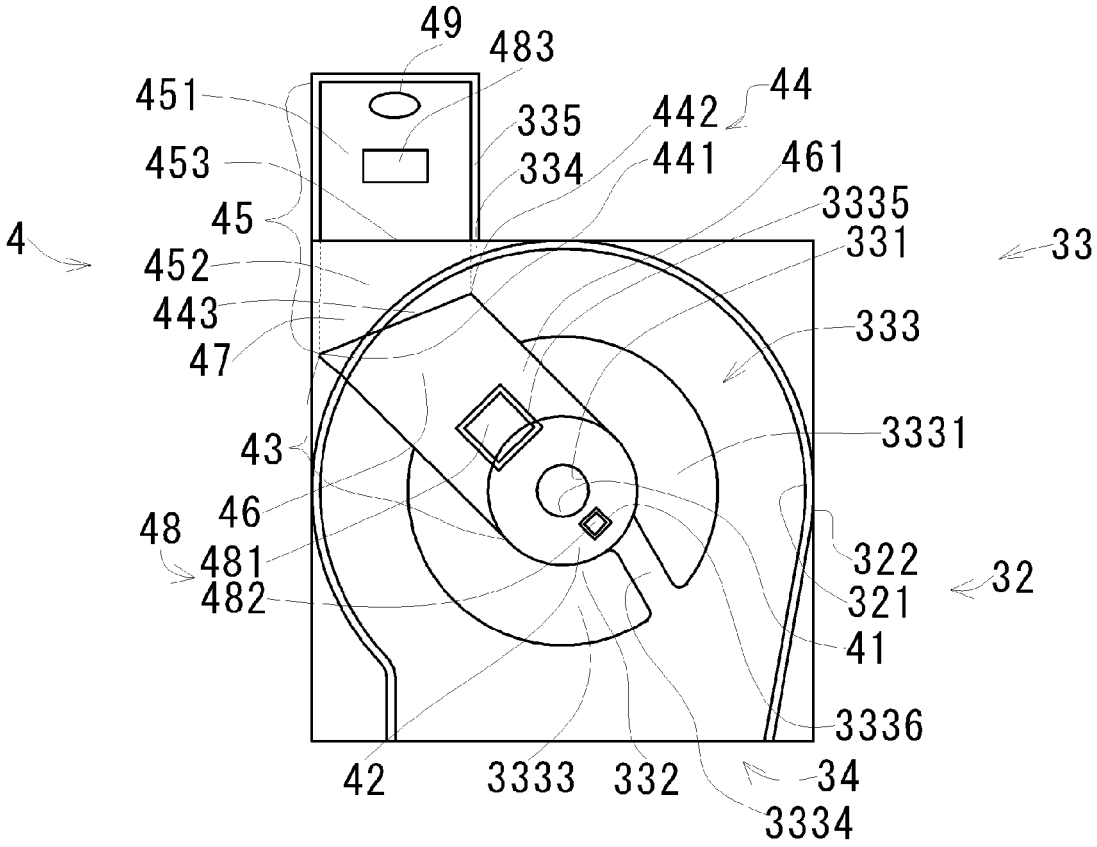
FIG. 3 is a plan view of a circuit board 4 and a housing 3 with a cover 31 removed in accordance the first preferred embodiment of the present invention.

FIG. 3 is a plan view of the circuit board 4 and the housing 3 with the cover 31 removed.

As illustrated in FIG. 1, the exterior of the housing appears substantially in the shape of a square when viewed from above along the central axis J1. The housing 3 includes the cover 31, which defines an upper surface thereof; the base 33, which defines a lower surface thereof; a side wall portion 32; and the air outlet 34. The side wall portion 32 joins the cover and the base 33 to each other, and is arranged radially opposite an imaginary circle joining tops of the blades 214. In addition, the base 33 has a base protruding portion 335 arranged at a position close to an upstream end of a flow path of air (i.e., an upper left corner in FIG. 4). The base protruding portion 335 extends radially outward of an outside wall 322 of the side wall portion 32 of the housing 3 (see FIG. 3). The outside wall 322 is an outside surface of the side wall portion 32.

Both the cover 31 and the base 33 preferably are defined by a metallic plate, such as, for example, a steel sheet, whereas the side wall portion 32 is made of, for example, a resin. Because both the cover 31 and the base 33 are defined by a metallic plate, heat and the like generated in the windings of the armature 223 of the motor portion 2 are effectively conducted to an outside of the housing 3. Moreover, since each of the cover 31 and the base 33 is preferably defined by a metallic plate, made, for example by press-forming, a reduction in the axial dimension of the centrifugal fan 1, i.e., a slimming down of the centrifugal fan 1, can be achieved as compared to when both the cover 31 and the base 33 were made of a resin or similar material.

The cover 31 preferably has includes the cover opening 311, which serves as the air inlet, defined therein. The side wall portion 32 preferably includes an inside wall 321, which defines the flow path, and the outside wall 322, which defines an outside surface of the housing 3. The base 33 preferably includes the fixing hole 331, a hub arrangement portion 332, a wind tunnel defining portion 333, a side wall corresponding portion 334, and the base protruding portion 335 (see FIG. 3). The fixing hole 331 is used to fix the bearing housing 221 (see FIG. 2). The hub arrangement portion 332, which is annular in shape, is arranged axially opposite the motor portion 2 and an opening of the rotatable hub 211. The wind tunnel defining portion 333 defines a portion of a wind tunnel 35. The side wall corresponding portion 334 receives the side wall portion 32 so that the wind tunnel 35 is enclosed. The base protruding portion 335 extends radially outward from one side of the outside wall 322 of the side wall portion 32. As illustrated in FIG. 4, the side wall portion 32 preferably includes screw holes 36 defined therein which are arranged to attach the centrifugal fan 1 to various devices. The screw holes 36 are preferably defined in two of four corners of the housing 3. It should also be noted that any other desirable types of fixing members other than screws and screw holes could be used.

Next, the flow path will now be described below with reference to FIG. 4. The air outlet 34 is defined in one side of the housing 3. The wind tunnel 35 is defined inside the housing 3. The wind tunnel 35 is a space enclosed axially by the cover above and the base 33 below, and radially by an outer circumference of the impeller cup 215 and the inside wall 321 of the side wall portion 32. The wind tunnel 35 preferably has a substantially spiraled shape with the central axis J1 at its center, and serves as the flow path of air traveling toward the air outlet 34. In addition, in a section of the wind tunnel 35 taken along a plane perpendicular or substantially perpendicular to the central axis J1 of the centrifugal fan 1, the width of the wind tunnel 35 gradually increases toward the air outlet 34. Note that, regarding the wind tunnel 35, the distance between the outer circumference of the impeller cup 215 and the inside wall 321 of the side wall portion 32 may be constant regardless of the distance from the air outlet 34.

As illustrated in FIG. 3, two base opening portions 3331 and 3333, both of which are preferably in the shape of a circular arc with the central axis J1 for its center, are arranged, along with a rib 3334 therebetween, around the hub arrangement portion 332. Both the base opening portions 3331 and 3333, which are arranged around the hub arrangement portion 332, serve as an air inlet of the centrifugal fan 1, together with the cover opening 311 defined in the cover 31 (see FIG. 1). Accordingly, the base opening portions 3331 and 3333 of the base 33 will be hereinafter referred to as the "lower air inlets" 3331 and 3333, whereas the cover opening 311 of the cover 31 will be hereinafter referred to as the "upper air inlet" 311.

In the centrifugal fan 1, the impeller 213 attached to the hub 211 is arranged to rotate clockwise (in a direction indicated by arrow Y1 in FIG. 4) when viewed from above along the central axis J1. The rotation of the impeller 213 causes air in the vicinity of the centrifugal fan 1 to be taken into the housing 3 through all of the lower air inlets 3331 and 3333 and the upper air inlet 311 (see FIG. 1). The air taken in travels substantially along the rotation direction of the impeller 213 while at the same time being guided radially outward, away from the central axis J1, by a centrifugal force, and travels through the wind tunnel 35 to be discharged through the air outlet 34. As described above, the centrifugal fan 1 is arranged to blow air in such a manner that the air is taken in along the central axis J1, and discharged radially outward, away from the central axis J1. At this time, the air flow quantity at the air outlet 34 is greatest in the vicinity of an edge that is farthest from the upstream end of the flow path (i.e., in the vicinity of a lower right-hand corner in FIG. 4).

Referring to FIG. 3, a control circuit portion preferably includes the circuit board 4, a plurality of electronic components 48, and a terminal portion 49. The electronic components 48 are mounted on the circuit board 4 and arranged to exercise control over the turning on and off of electricity to the armature 223. The electronic components 48 are preferably connected to the terminal portion 49 through a wiring pattern. A lead wire connected to an external power supply or the like is soldered to the terminal portion 49. The electronic components 48 include at least one element having a large volume. Examples of such a large-volume element include a capacitor, a Hall element, a resistor, a transistor, and an IC, for example.

Referring to FIG. 3, the circuit board 4 includes the fixing hole 41; a hub corresponding portion 42, which is annular in shape; a first extension portion 43; and a second extension portion 45. The fixing hole 41 is arranged to fix the bearing housing 221. The hub corresponding portion 42 is arranged above the hub arrangement portion 332 of the base 33, which is arranged axially opposite the motor portion 2, that is, the opening of the rotatable hub 211. The first extension portion 43 extends radially outward from the hub corresponding portion 42 to be joined to the second extension portion 45 through an extension portion boundary 443, which is a bend portion 44. The extension portion boundary 443 defines a line joining a substantial middle of a first bend portion 441 and a substantial middle of a second bend portion 442 to each other. The second extension portion 45 includes a circuit board protruding portion 451 and a second extension intermediate portion 452. The circuit board protruding portion 451 is arranged above the base protruding portion 335 of the housing 3. The second extension intermediate portion 452 is arranged between the first extension portion 43 and the circuit board protruding portion 451.

Next, the arrangement of the electronic components 48 will now be described below with reference to FIGS. 3 and 4. The base 33 includes two electronic component accommodating hole portions 3335 and 3336 defined at positions axially overlapping with the circuit board 4. The electronic component accommodating hole portion 3335 accommodates an electronic component 481 mounted on an air inlet corresponding portion 461 of the circuit board 4. In addition, on the hub corresponding portion 42 of the circuit board 4, a Hall element 482, which is used to detect a rotational speed of the motor portion 2, is provided at a position axially opposite the field magnet 212 (see FIG. 2). The electronic component accommodating hole portion 3336 accommodates the Hall element 482. The above arrangement contributes to reducing the axial dimension (i.e., thickness) of the centrifugal fan to slim down the centrifugal fan.

Moreover, at least one of the electronic components 48 is mounted on the circuit board protruding portion 451. The electronic component(s) 48 mounted on the circuit board protruding portion 451 is, for example, an electronic component 483 such as a capacitor. The electronic component 483 is arranged to exercise control over turning on and off of electricity toward the armature 223 of the motor portion 2, and is electrically connected to the other electronic components 48 via a wiring leading from the hub corresponding portion 42 immediately below the motor portion 2. Furthermore, the terminal portion 49, to which the lead wire connected to the external power supply or the like is soldered, is provided on the circuit board protruding portion 451. This arrangement facilitates the soldering of the lead wire, and also prevents the lead wire from being pressed down by the housing. This reduces a burden on the lead wire, thereby reducing the likelihood of a break in the lead wire or other problems.

The electronic component 483 is a component that needs not be arranged on the hub corresponding portion 42, and may be a component having a large volume. Elimination of such an electronic component from the hub corresponding portion 42 allows a reduction in area of the hub corresponding portion 42, and a widening of the wind tunnel 35. In addition, mounting of an electronic component 48 having a large volume and a great height on the circuit board protruding portion 451 outside of the housing 3, instead of on the hub corresponding portion 42, allows a reduction in the axial dimension of the motor portion 2. This contributes to achieving a slimming down of the centrifugal fan 1.

Next, the positional relationship between the housing 3 and the circuit board 4 will now be described in detail below with reference to FIG. 3. The circuit board 4 is arranged such that the fixing hole 331 of the base 33 and the fixing hole 41 of the circuit board 4 are superimposed one upon the other, so that the bearing housing 221 can be inserted inside the fixing holes 331 and 41. The hub corresponding portion 42 of the circuit board 4 is arranged on the substantially annular hub arrangement portion 332, which spreads radially outward from the fixing holes 331 and 41. The first extension portion 43 of the circuit board 4 extends radially outward from the hub corresponding portion 42 toward the side wall portion 32.

That portion of the first extension portion 43 of the circuit board 4 which corresponds to the wind tunnel defining portion 333 of the base 33 will be referred to as a wind tunnel corresponding portion 46. That is, the wind tunnel corresponding portion 46 is that portion of the circuit board 4 which corresponds to the wind tunnel 35 of the centrifugal fan 1. Further, that portion of the wind tunnel corresponding portion 46 which corresponds to any air inlet is referred to as the air inlet corresponding portion 461. The circuit board 4 is bent at the boundary between the first extension portion 43 and the second extension portion 45 to preferably define a chevron shape, for example. This portion is referred to as the bend portion 44. Here, an upstream end of the width of the bend portion 44 is referred to as the first bend portion 441, a downstream end of the width of the bend portion 44 is referred to as the second bend portion 442, and the line joining the substantial middle of the first bend portion 441 and the substantial middle of the second bend portion 442 is referred to as the extension portion boundary 443. The first bend portion 441 is positioned radially outward of the inside wall 321 of the housing 3. Note that each of the first bend portion 441 and the second bend portion 442 may be either a bend point or a bend curve. In the present preferred embodiment, each of the first bend portion 441 and the second bend portion 442 is represented by a bend point.

The second extension portion 45 includes the second extension intermediate portion 452 and the circuit board protruding portion 451. The second extension intermediate portion 452 extends along an upstream portion of the outside wall 322 of the side wall portion 32. The circuit board 4 extends along the base protruding portion 335 radially outward of the outside wall 322, from an intersection of the upstream portion of the outside wall 322 and a midstream portion of the outside wall 322. That portion of the second extension portion 45 which protrudes radially outward from the outside wall 322 of the housing 3 is referred to as the circuit board protruding portion 451. Here, a boundary 453 between the second extension intermediate portion 452 and the circuit board protruding portion 451 coincides with a portion of the midstream portion of the outside wall 322 of the housing 3. The circuit board protruding portion 451 is arranged on and fixed to the base protruding portion 335.

Figure 5:
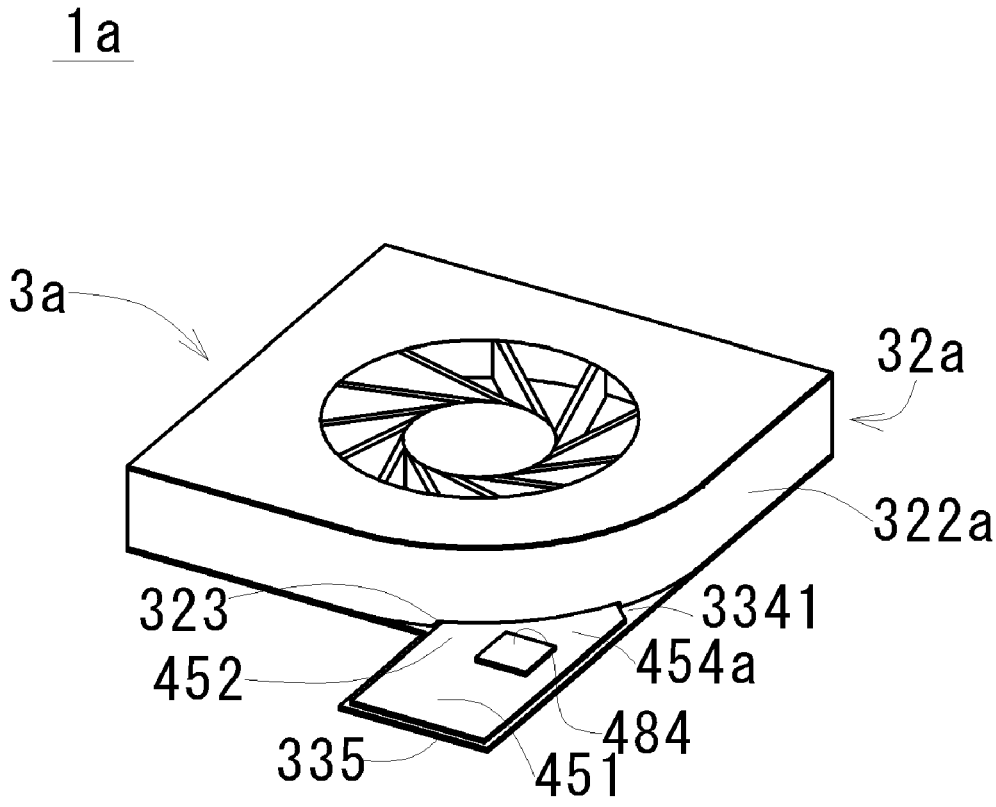
FIG. 5 is a perspective view of a centrifugal fan 1*a* according to a second preferred embodiment of the present invention.

The circuit board 4 is preferably adhered to the base 33. Specifically, the circuit board 4 is placed between the side wall portion 32 and the base 33 and thereby secured at a "circuit board side wall corresponding portion" 47. Referring to FIG. 5, a circuit board guide groove 323 is defined at a lower end of a portion of the side wall portion 32 of the housing 3 which is axially opposed to the second extension intermediate portion 452. The circuit board guide groove 323 extends from the inside wall 321 to the outside wall 322. The circuit board side wall corresponding portion 47 is located between the circuit board guide groove 323 and that portion of the side wall corresponding portion 334 of the base 33 which is axially opposed to the circuit board guide groove 323, so that the circuit board 4 is secured by the housing 3.

The dimensions of the circuit board guide groove 323, the circuit board side wall corresponding portion 47, and the side wall corresponding portion 334 are arranged so that the side wall portion of the housing is sufficiently closed to prevent air from escaping from the wind tunnel 35 and traveling over the circuit board 4 in the direction of the circuit board protruding portion 451 and the base protruding portion 335.

In the centrifugal fan 1 according to the present preferred embodiment, the electronic component 483, which it is difficult to arrange within that area of the circuit board 4 which is axially opposed to an outer circumferential surface of the covered, substantially cylindrical hub 211, can be arranged on the circuit board protruding portion 451 of the circuit board 4.

Thus, some of the electronic components (e.g., the electronic component 483) are arranged radially outward from the wind tunnel 35. This allows a reduction in the diameter of the hub 211, and prevents the electronic components 48 from interfering with a flow of air in the flow path within the wind tunnel 35. Accordingly, the centrifugal fan 1 can be excellent in static pressure characteristic and air flow quantity characteristic.

Moreover, the circuit board 4 is bent at the bend portion 44. The circuit board 4 can thus be arranged so as not to interfere with a flow of air within the wind tunnel 35 or cause a reduction in the air flow quantity or wind velocity.

Furthermore, in the present preferred embodiment, the base protruding portion 335 and the circuit board protruding portion 451 are preferably arranged in the vicinity of an intersection of the upstream and midstream portions of the side wall portion 32 of the housing 3. It is known that both the air flow quantity and the air flow velocity are at their minimum near this intersecting portion. Because the circuit board 4 is arranged to protrude from this portion of the side wall portion 32, the centrifugal fan 1 has a reduced degree of obstruction to the air flow in the flow path, with an efficient formation of the flow path.

Furthermore, because the circuit board protruding portion 451, which protrudes from the outside wall 322 of the housing 3, is supported by the base protruding portion 335, the circuit board 4 is preferably prevented from bending and has an improved strength.

Second Preferred Embodiment

Figure 6:
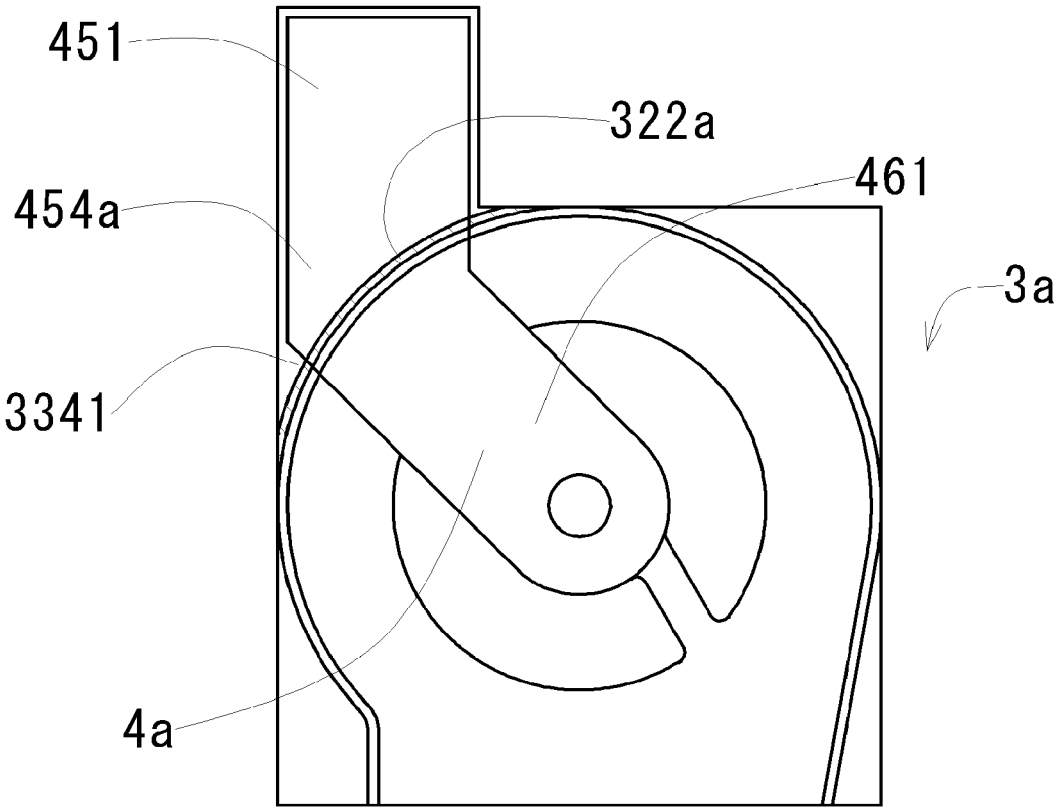
FIG. 6 is a plan view of a circuit board 4*a* and a housing 3*a* of the centrifugal fan 1*a* according to the second preferred embodiment of the present invention, with a cover 31*a* removed from the housing 3*a*.

FIG. 5 is a perspective view of a centrifugal fan 1*a* according to a second preferred embodiment of the present invention. FIG. 6 is a plan view of a circuit board 4*a* and a housing 3*a* of the centrifugal fan 1*a* according to the second preferred embodiment of the present invention, with a cover 31*a* removed from the housing 3*a*. The structure of the centrifugal fan 1*a* is similar to that of the centrifugal fan 1 according to the first preferred embodiment, except in the shape of a side wall portion 32*a* of the housing 3*a* and the arrangement of the electronic components 48. The other components of the centrifugal fan 1*a* are denoted by the same reference numerals as those used for the centrifugal fan 1 according to the first preferred embodiment.

The side wall portion 32*a* of the housing 3*a* of the centrifugal fan 1*a* has a different shape from that of the side wall portion 32 according to the first preferred embodiment. Specifically, that portion of the side wall portion 32*a* which is positioned in the vicinity of the base protruding portion 335 of the housing 3*a* defines a circular arc. In accordance with the formation of this curved surface, the base 33 has a "housing side wall outside portion" 3341 arranged radially outward of an outside wall 322*a* of the side wall portion 32*a*. In addition, the circuit board 4*a* has a "housing side wall outside portion corresponding portion" 454*a* arranged on the housing side wall outside portion 3341. The housing side wall outside portion corresponding portion 454*a* substantially corresponds to the second extension intermediate portion 452 according to the first preferred embodiment.

In comparison to the first preferred embodiment, that area of the circuit board 4*a* which is arranged radially outward of the side wall portion 32*a* of the housing 3*a* and in which the electronic components 48 can be arranged can be secured more widely, with improved flexibility in mounting the electronic components. In particular, the above-described arrangement of the second preferred embodiment is suitable, for example, when there is a desire to mount any electronic component 48 not on the air inlet corresponding portion 461 but such that the electronic component 48 is arranged to span portions of both the second extension intermediate portion 452 and the circuit board protruding portion 451 in the first preferred embodiment (see an electronic component 484 in FIG. 5).

Other Preferred Embodiments

FIGS. 7, 8, 9, 10, 11, 12, 13, 14, 15, 16, and 17 are each plan views of the circuit board 4 and the housing 3 of a centrifugal fan according to other preferred embodiments of the present invention, with the cover 31 removed from the housing 3. Characteristic features of each of these preferred embodiments will now be described below.

Figure 7:
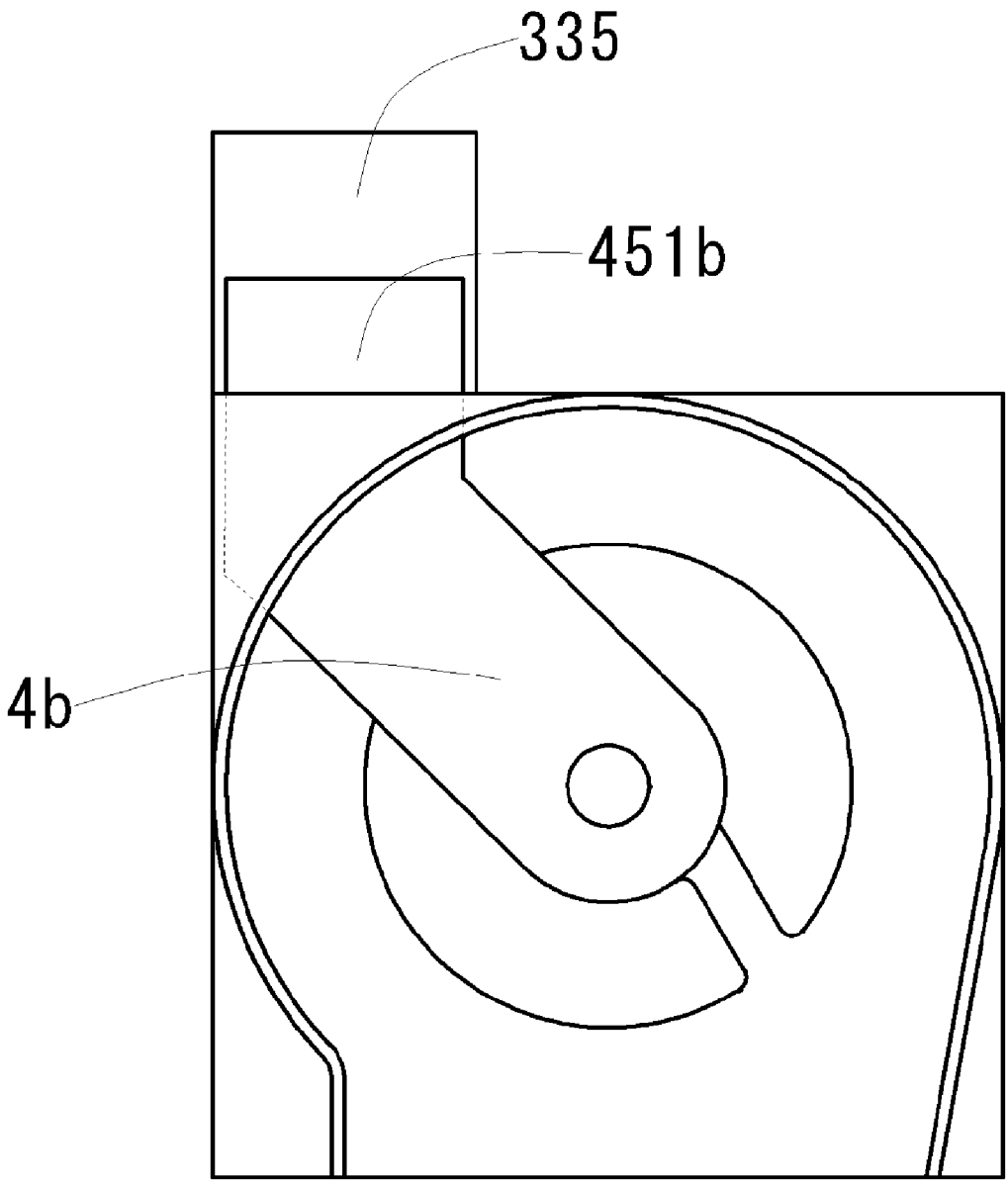
FIG. 7 is a plan view of a circuit board 4*b* and a housing 3*b* of a centrifugal fan according to another preferred embodiment of the present invention, with a cover 31*b* removed from the housing 3*b*.

In a circuit board 4*b* as illustrated in FIG. 7, a top end of a circuit board protruding portion 451*b* is arranged radially inward of a top end of the base protruding portion 335.

Figure 8:
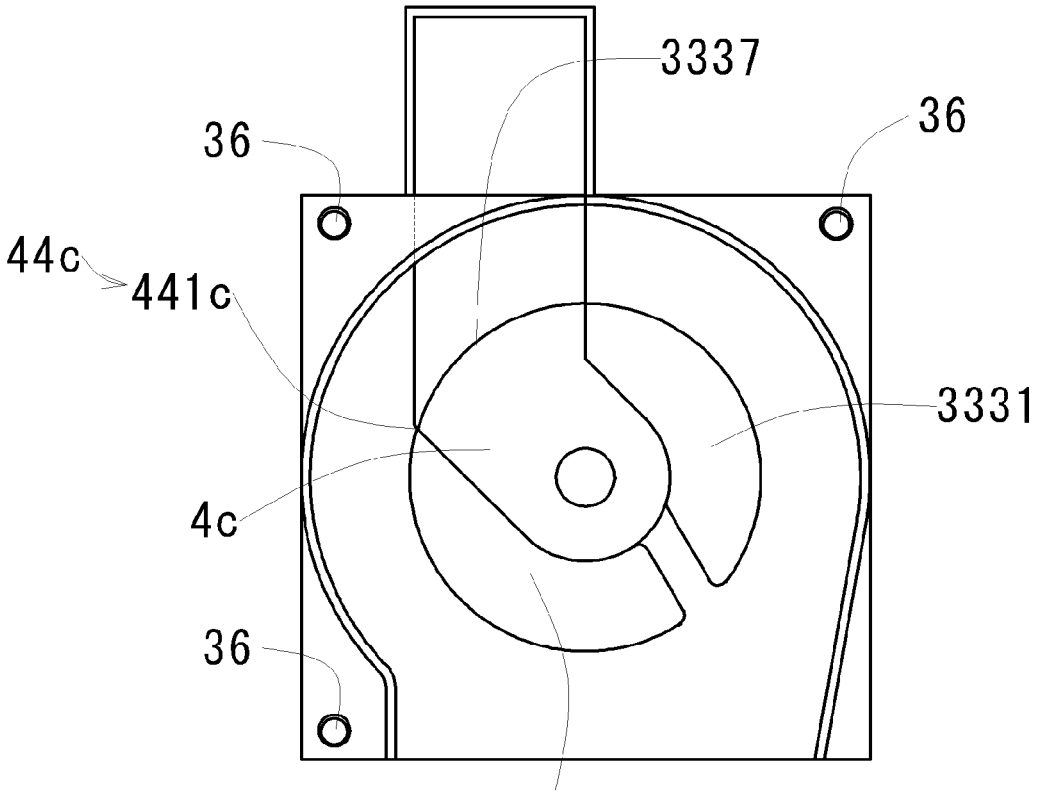
FIG. 8 is a plan view of a circuit board 4*c* and a housing 3*c* of a centrifugal fan according to yet another preferred embodiment of the present invention, with a cover 31*c* removed from the housing 3*c*.

In a circuit board 4*c* as illustrated in FIG. 8, a point 441*c* within a bend portion 44*c* is positioned on an outer circumference of the lower air inlets 3331 and 3333 or an imaginary extension line 3337 thereof. This arrangement allows the bend portion of the circuit board to axially overlap with the outer circumference of the lower air inlets 3331 and 3333 or the imaginary extension line 3337 thereof. The circuit board can thus be arranged efficiently to avoid a wind loss. This arrangement is suitable in the case where the screw holes 36 are provided in three of four corners of a housing 3*c*, for example.

Figure 9:
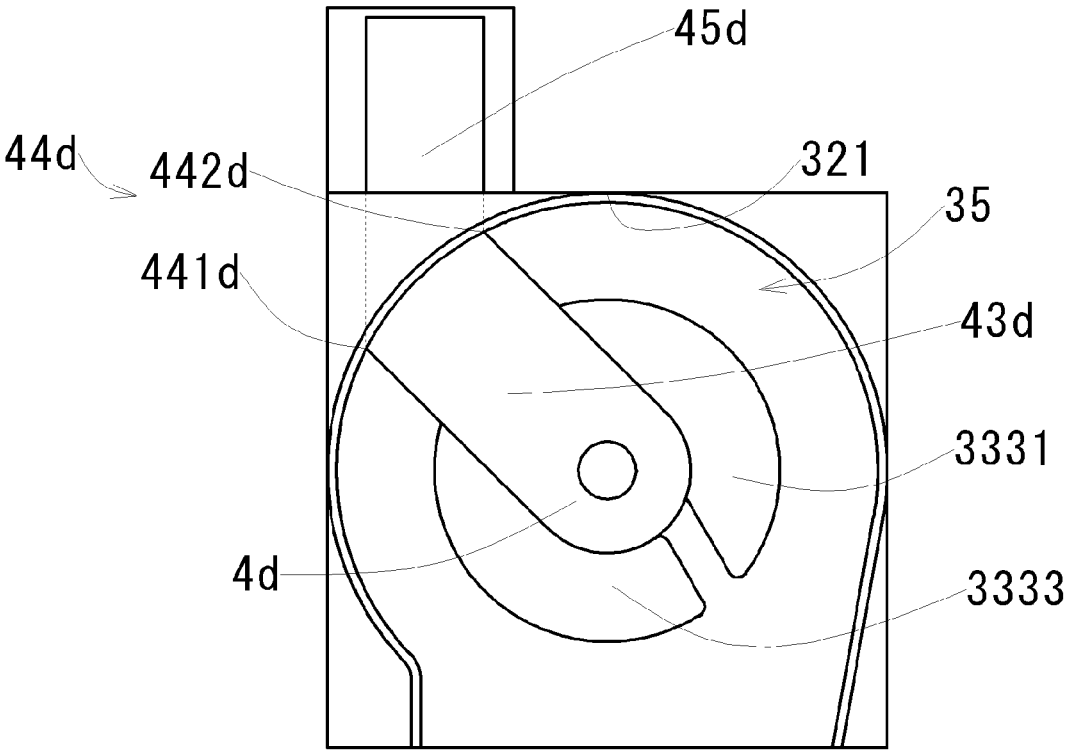
FIG. 9 is a plan view of a circuit board 4*d* and a housing 3*d* of a centrifugal fan according to yet another preferred embodiment of the present invention, with a cover 31*d* removed from the housing 3*d*.

In a circuit board 4*d* as illustrated in FIG. 9, two points 441*d* and 442*d* in a bend portion 44*d* are both arranged on an outer circumference of the wind tunnel 35, and abut a lower end of the inside wall 321 of the side wall portion 32. In addition, in the circuit board 4*d*, a first extension portion 43*d* and a second extension portion 45*d* have different widths. The width of the first extension portion 43*d* is greater than that of the second extension portion 45*d*. This contributes to increasing the area of the lower air inlets 3331 and 3333, and correspondingly increasing the quantity of air taken in. At the same time, since the bend portion 44*d* of the circuit board 4*d* is arranged outside of the wind tunnel 35, the interference of the circuit board 4*d* with the flow of air in the flow path is relatively little. Moreover, since the bend portion 44*d* of the circuit board 4*d* overlaps with the side wall portion of the housing, the circuit board can be arranged efficiently to avoid a wind loss.

Figure 10:
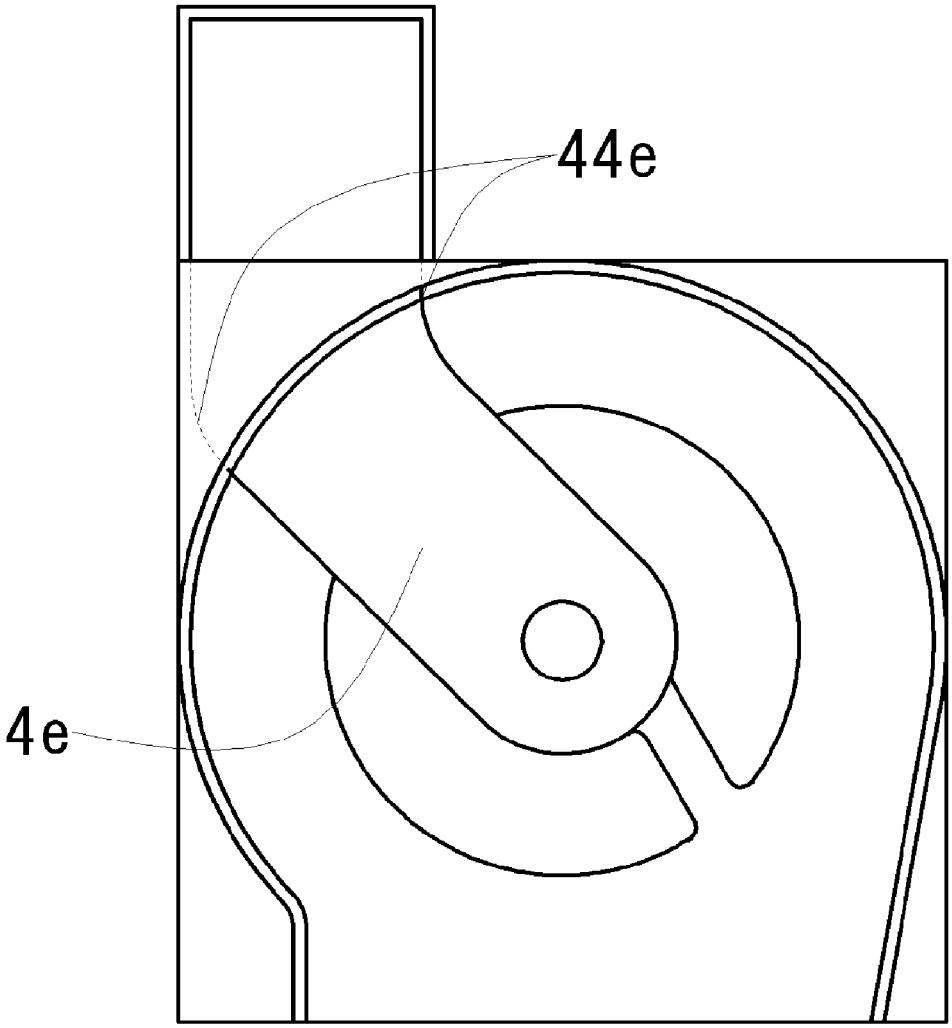
FIG. 10 is a plan view of a circuit board 4*e* and a housing 3*e* of a centrifugal fan according to yet another preferred embodiment of the present invention, with a cover 31*e* removed from the housing 3*e*.

In a circuit board 4*e* as illustrated in FIG. 10, a bend portion 44*e* has a curved shape.

Figure 11:
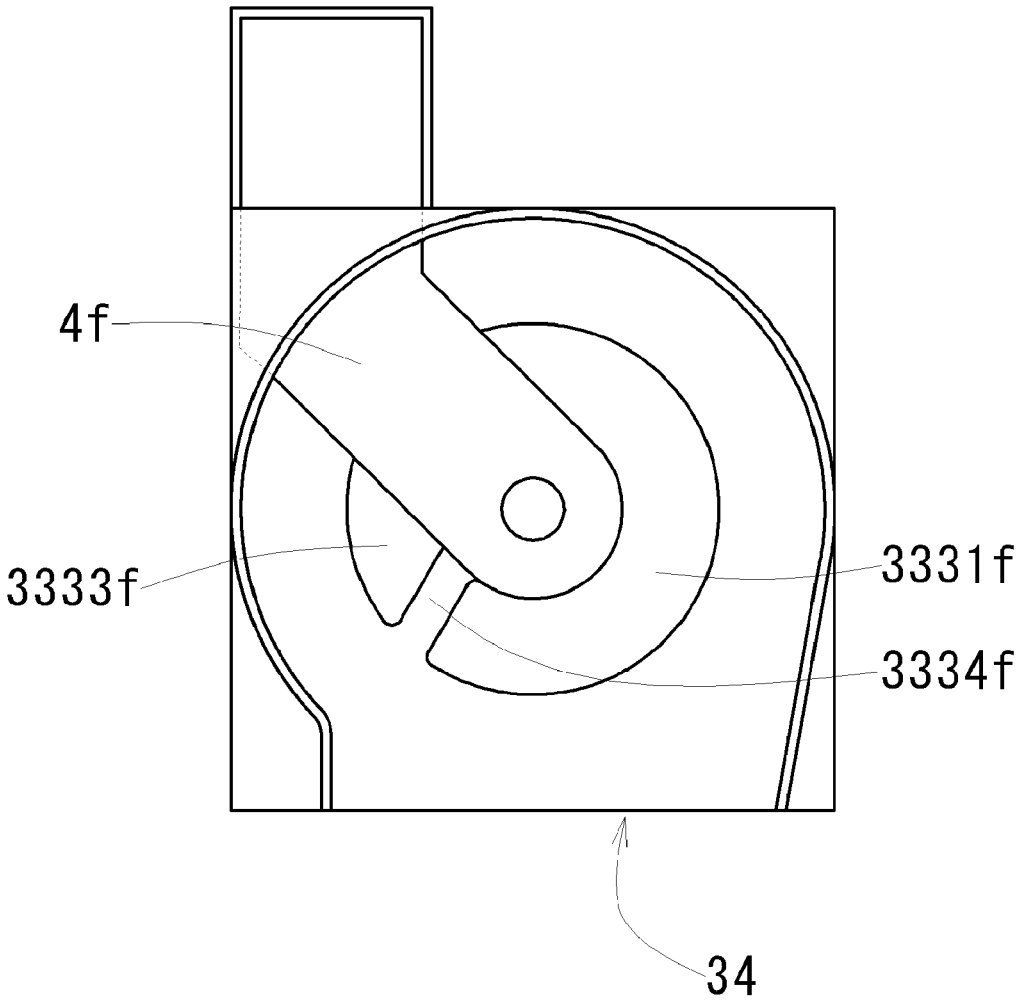
FIG. 11 is a plan view of a circuit board 4*f* and a housing 3*f* of a centrifugal fan according to yet another preferred embodiment of the present invention, with a cover 31*f* removed from the housing 3*f*.

Regarding a circuit board 4*f* as illustrated in FIG. 11, a rib 3334*f* is provided in the vicinity of that portion of the air outlet 34 where the wind velocity is lowest (on the left-hand side in FIG. 11). Thus, the rib 3334*f* hardly acts to decrease the quantity of air taken in through lower air inlets 3331*f* and 3333*f*, maximizing the quantity of air taken in.

Figure 12:
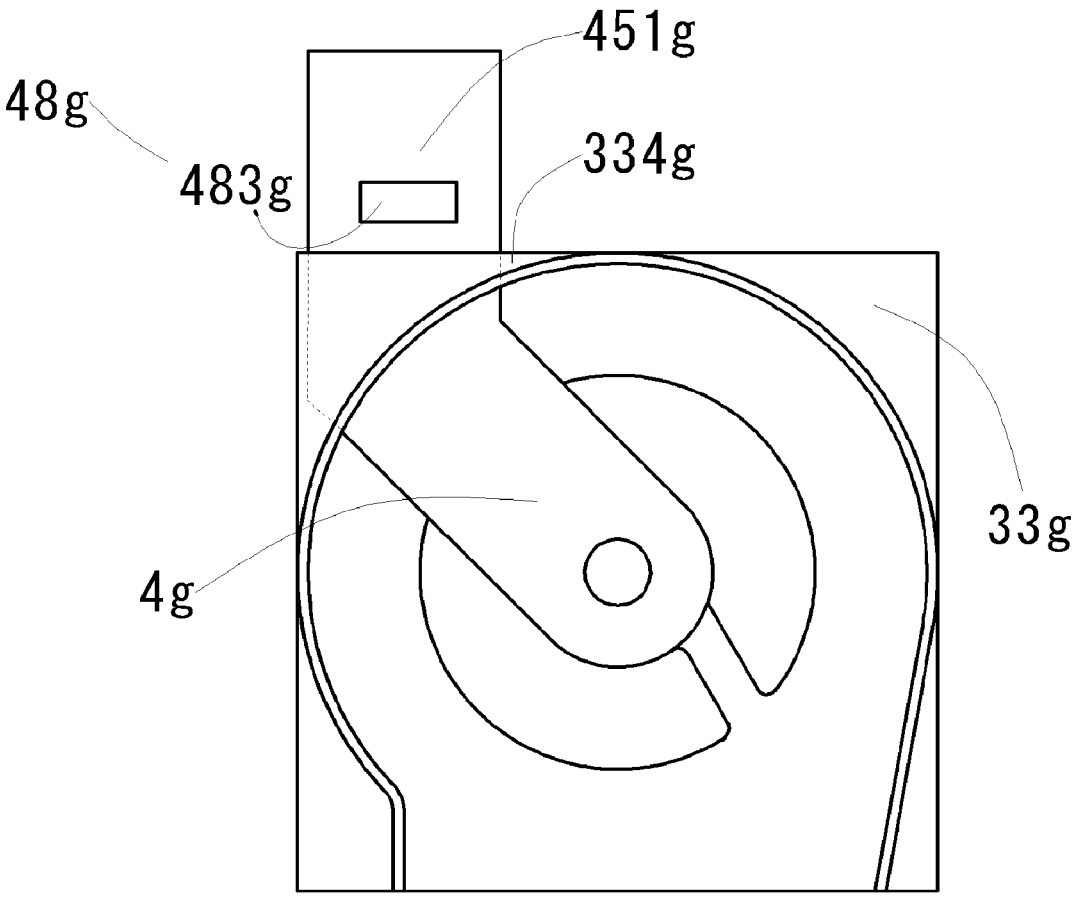
FIG. 12 is a plan view of a circuit board 4*g* and a housing 3*g* of a centrifugal fan according to yet another preferred embodiment of the present invention, with a cover 31*g* removed from the housing 3*g*.

A base 33*g* as illustrated in FIG. 12 is substantially in the shape of a square, and does not have a base protruding portion. Accordingly, a circuit board protruding portion 451*g* of a circuit board 4*g* is supported by a side wall corresponding portion 334*g* of the base 33*g*. In addition, an electronic component 483*g* is mounted on a rear surface of the circuit board protruding portion 451*g*. This arrangement simplifies the shape of the base 33*g*, leading to a reduction in production cost. Moreover, since electronic components 48*g* can be mounted on both front and rear surfaces of the circuit board protruding portion 451*g*, a total area of the circuit board 4*g* in which the electronic components 48*g* can be mounted can be increased to improve flexibility in mounting the electronic components.

Figure 13:
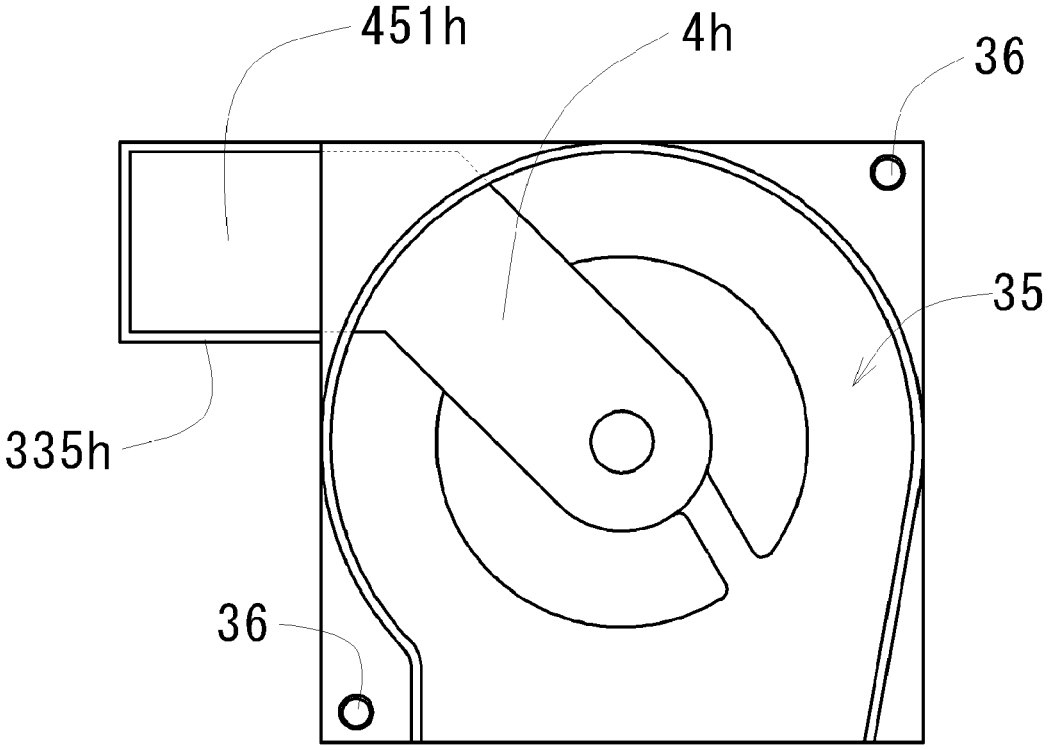
FIG. 13 is a plan view of a circuit board 4*h* and a housing 3*h* of a centrifugal fan according to yet another preferred embodiment of the present invention, with a cover 31*h* removed from the housing 3*h*.

In a circuit board 4*h* as illustrated in FIG. 13, a circuit board protruding portion 451*h* is arranged to extend, in a plan view, in a direction perpendicular or substantially perpendicular to the flow path of air in the vicinity of the air outlet (see an upper end of a left-hand portion of the side wall portion in FIG. 13). Even when there is only a limited space radially outside of that portion of the side wall portion 32 which is on the opposite side of the central axis J1 with respect to the air outlet, a base protruding portion 335*h* and the circuit board protruding portion 451*h* can be arranged to extend, in a plan view, in the direction substantially perpendicular to the flow path of air in the vicinity of the air outlet to maximize the size of the wind tunnel 35. This arrangement allows a design of a centrifugal fan with an excellent static pressure characteristic and an excellent air flow quantity characteristic. This arrangement is suitable in the case where the screw holes 36 are provided in two of four corners of a housing 3*h*.

Figure 14:
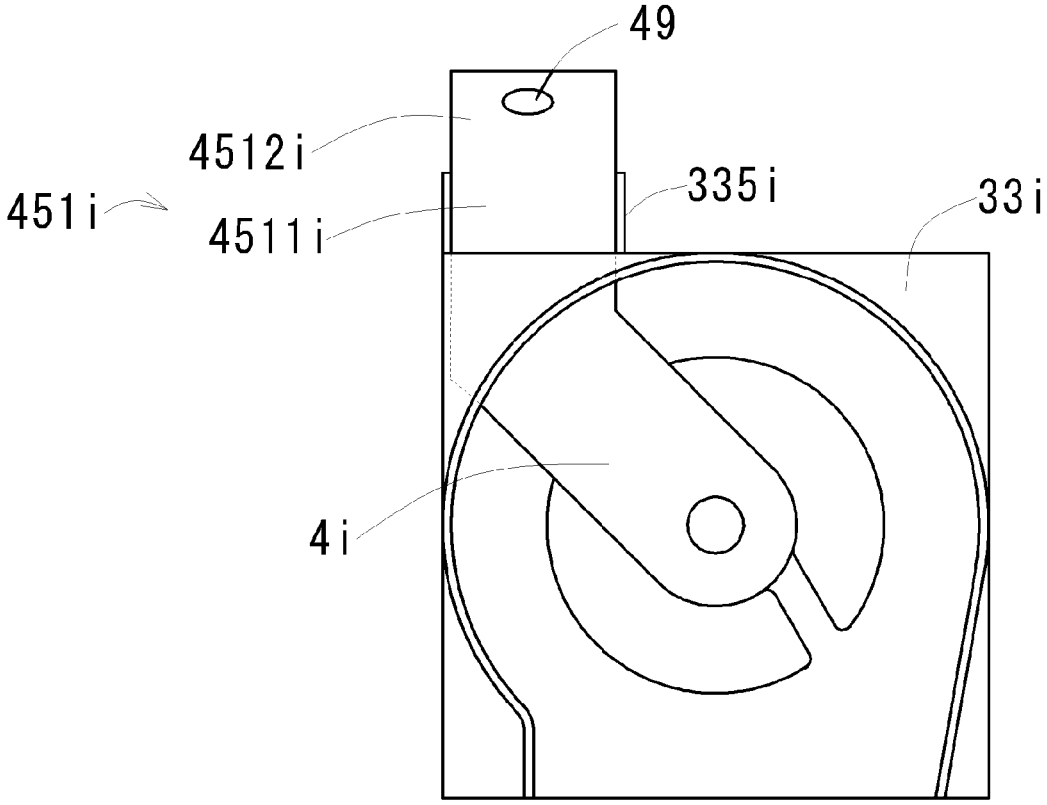
FIG. 14 is a plan view of a circuit board 4*i* and a housing 3*i* of a centrifugal fan according to yet another preferred embodiment of the present invention, with a cover 31*i* removed from the housing 3*i*.

In a circuit board 4*i* as illustrated in FIG. 14, a circuit board protruding portion 451*i* is arranged to protrude radially outward farther than a base protruding portion 335*i*. The circuit board protruding portion 451*i* includes a circuit board protruding base portion 4511*i*, which is supported by the base protruding portion 335*i*, and a circuit board protruding end portion 4512*i*, which is not supported by the base protruding portion 335*i*. The terminal portion 49 is provided on a rear surface of the circuit board protruding end portion 4512*i*. Accordingly, the lead wire can be drawn downward from the centrifugal fan to be connected to the external power supply.

Figure 15:
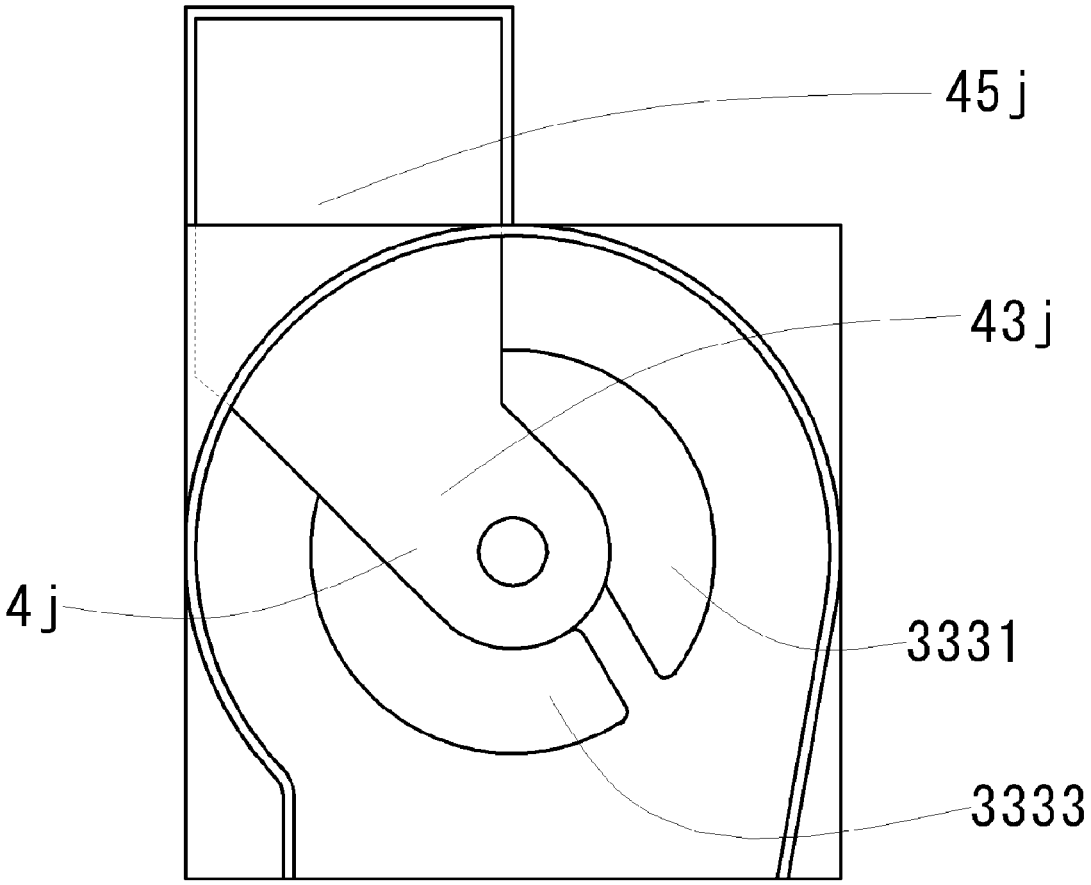
FIG. 15 is a plan view of a circuit board 4*j* and a housing 3*j* of a centrifugal fan according to yet another preferred embodiment of the present invention, with a cover 31*j* removed from the housing 3*j*.

In a circuit board 4*j* as illustrated in FIG. 15, a first extension portion 43*j* and a second extension portion 45*j* have different widths, as with the circuit board 4*d* as illustrated in FIG. 9. The width of the second extension portion 45*j* is greater than that of the first extension portion 43*j*. In addition, no electronic components are arranged on the wind tunnel corresponding portion 46, and only a wiring pattern is arranged on the wind tunnel corresponding portion 46. Therefore, a large number of electronic components 48 can be arranged on the second extension portion 45*j*, with a minimized width of the first extension portion 43*j*, which spans the lower air inlets 3331 and 3333 and the wind tunnel 35. When the first extension portion 43*j* has a decreased width, the circuit board is less likely to adversely affect the flow of air within the wind tunnel 35, the air flow quantity characteristic, or a wind velocity characteristic.

Figure 16:
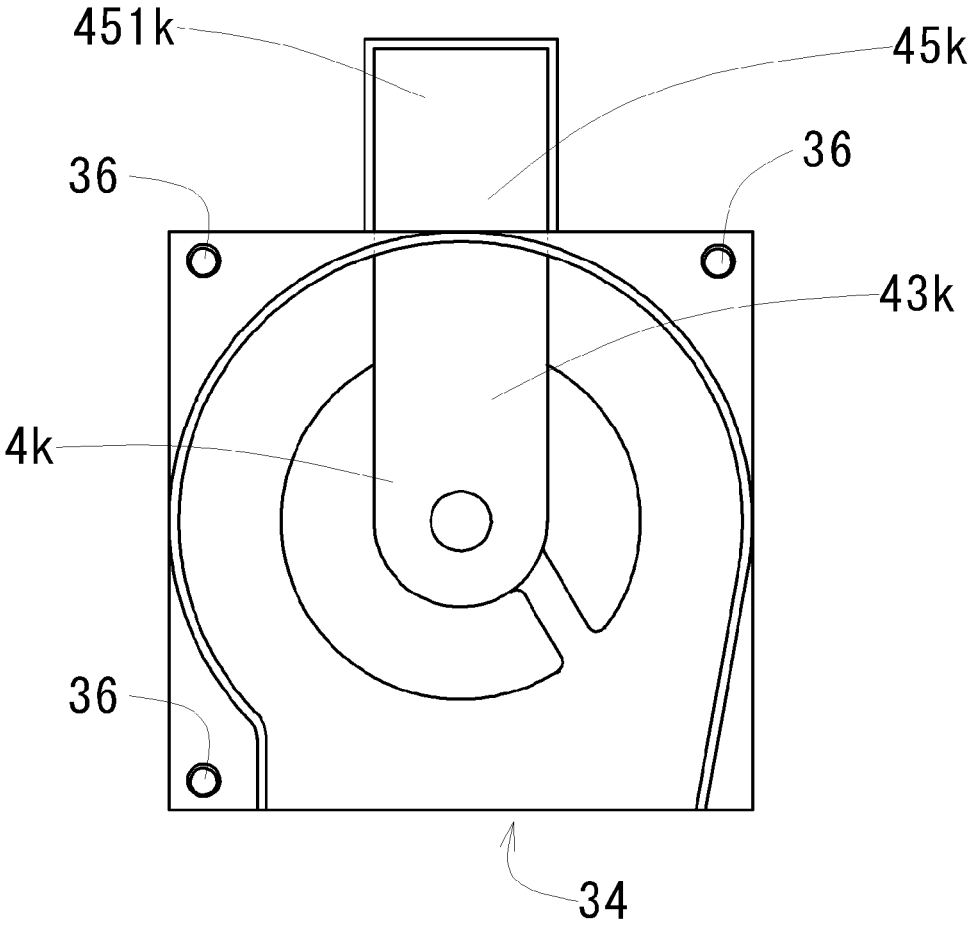
FIG. 16 is a plan view of a circuit board 4*k* and a housing 3*k* of a centrifugal fan according to yet another preferred embodiment of the present invention, with a cover 31*k* removed from the housing 3*k*.

A circuit board 4*k* as illustrated in FIG. 16 does not have a bend portion. In other words, a first extension portion 43*k* and a second extension portion 45*k* are joined to define a straight line. A circuit board protruding portion 451*k* protrudes from a side of a housing 3*k* opposite to a side where the air outlet 34 is defined. This arrangement is suitable in the case where the screw holes 36 are provided in three of four corners of the housing 3*k*.

Figure 17:
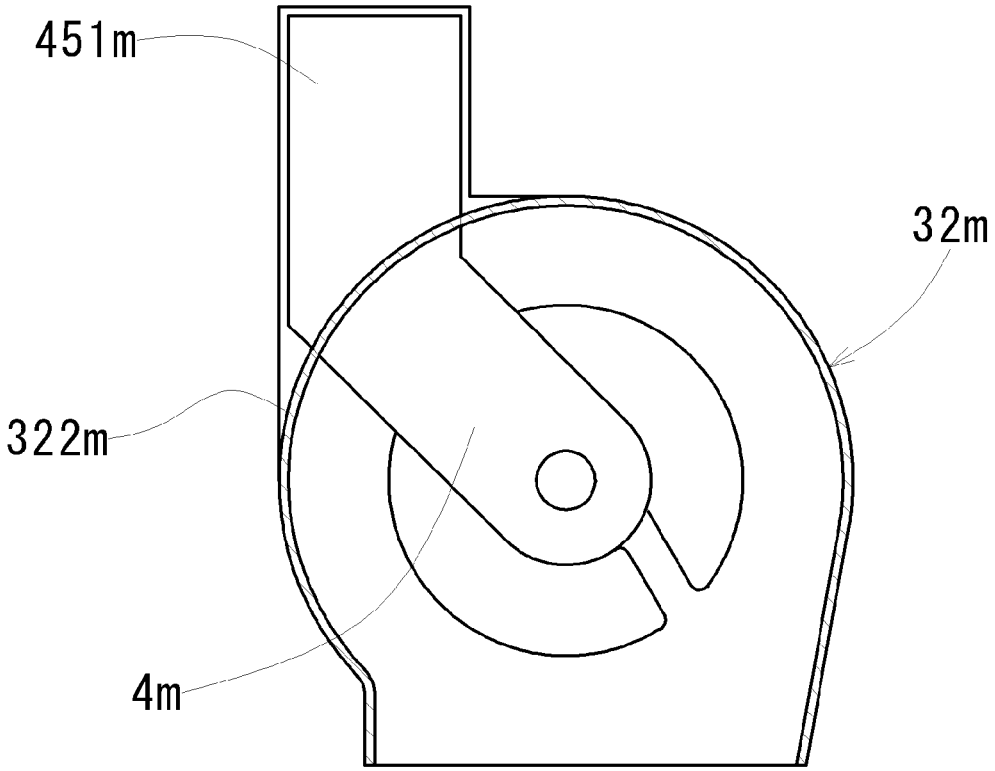
FIG. 17 is a plan view of a circuit board 4*m* and a housing 3*m* of a centrifugal fan according to yet another preferred embodiment of the present invention, with a cover 31*m* removed from the housing 3*m*.

Regarding a circuit board 4*m* as illustrated in FIG. 17, a side wall portion 32*m* of a housing 3*m* is substantially in the shape of a circle. A circuit board protruding portion 451*m* protrudes from an intersection of an upstream portion of an outside wall 322*m* of the housing 3*m* and a midstream portion of the outside wall 322*m*.

While preferred embodiments of the present invention have been described above, it is to be understood by those skilled in the art that the present invention is not limited to the above-described preferred embodiments, but that variations and modifications are possible.

For example, the base protruding portion 335 and the circuit board protruding portion 451 may have different widths in other preferred embodiments. That is, the width of the base protruding portion 335 may be greater than that of the circuit board protruding portion 451. Conversely, the width of the base protruding portion 335 may be smaller than that of the circuit board protruding portion 451.

Further, while the air inlets are preferably defined in both the cover and the base in the above-described preferred embodiments (a two-side intake type), this is not essential to the present invention. The air inlet(s) may be defined in only one of the cover and the base in other preferred embodiments (a one-side intake type).

Furthermore, the housing 3 may not necessarily be substantially in the shape of a square, in other preferred embodiments. For example, the housing 3 may be in the shape of a rectangle.

Furthermore, while each of the first and second extension portions 43 and 45 of the circuit board is arranged to extend in a straight line in the above-described preferred embodiments, this is not essential to the present invention. For example, each of the first and second extension portions 43 and 45 may be arranged to extend in a curved line in other preferred embodiments. Also, each of the first and second extension portions 43 and 45 may increase or decrease in width at a halfway point.

Furthermore, while the base protruding portion 335 is formed integrally with the base portion 33 in the above-described preferred embodiments, the base protruding portion 335 may be formed separately from the base portion 33 in other preferred embodiments.

While preferred embodiments of the present invention have been described above, these are illustrated only by way of example, and it is to be understood that variations and modifications will be apparent to those skilled in the art without departing the scope and spirit of the present invention. The scope of the present invention, therefore, is to be determined solely by the following claims.

What is claimed is:

1. A centrifugal fan comprising:

a hub substantially in the shape of a cylinder with a covered end centered on a central axis;

an impeller arranged radially outward of the hub;

a magnet attached to an inside of the hub;

an armature arranged radially opposite the magnet;

a bearing mechanism arranged to support the hub such that the hub is rotatable about the central axis with respect to the armature;

a bearing housing arranged to support the bearing mechanism;

a base arranged to support a lower end portion of the bearing housing, the base being a plate-shaped member;

a side wall including an air outlet defined therein, and arranged radially outward of the impeller to surround the impeller;

a cover including an air inlet defined therein, and arranged axially above the side wall;

a housing including the base, the side wall, and the cover;

a circuit board arranged on an upper surface of the base; and a control circuit portion including electronic components and arranged on the circuit board; wherein the circuit board includes a protruding portion arranged to protrude outward of an outer surface of the side wall of the housing in a direction including a radial component, the protruding portion including a freely extending portion which is not in direct surface-to-surface contact with the base;

at least one of the electronic components is arranged on the protruding portion; and a terminal portion is completely arranged on the freely extending portion of the protruding portion.

2. The centrifugal fan according to claim 1, wherein the terminal portion has a wire connected to an external power supply.

3. The centrifugal fan according to claim 1, wherein the base includes at least one hole defined in a portion thereof which is axially opposed to the circuit board; and one or more of the electronic components are arranged in the at least one hole.

4. The centrifugal fan according to claim 1, wherein at least a portion of an exterior of the side wall of the housing includes a circular arc shaped portion.

5. The centrifugal fan according to claim 1, wherein the hub has a diameter equal to or less than about 20 mm.

6. A centrifugal fan comprising:

a hub substantially in the shape of a cylinder with a covered end centered on a central axis;

an impeller arranged radially outward of the hub;

a magnet attached to an inside of the hub;

an armature arranged radially opposite the magnet;

a bearing mechanism arranged to support the hub such that the hub is rotatable about the central axis with respect to the armature;

a bearing housing arranged to support the bearing mechanism;

a base arranged to support a lower end portion of the bearing housing;

a side wall including an air outlet defined therein, and arranged radially outward of the impeller to surround the impeller;

a cover including an air inlet defined therein, and arranged axially above the side wall;

a housing including the base, the side wall, and the cover;

a circuit board arranged on an upper surface of the base; and a control circuit portion including electronic components and arranged on the circuit board; wherein the circuit board includes a protruding portion arranged to protrude radially outward of an outer surface of the side wall of the housing;

at least one of the electronic components is arranged on the protruding portion;

the circuit board includes a hub corresponding portion arranged axially below the hub, a first extension portion arranged to extend substantially radially outward from the hub corresponding portion, a second extension portion arranged to extend from the first extension portion and including the protruding portion, and at least one bend portion; and the first and second extension portions are joined to each other through the bend portion.

7. The centrifugal fan according to claim 6, wherein the first and second extension portions have different widths.

8. The centrifugal fan according to claim 6, wherein the base includes a base-side air inlet defined therein; and a portion of the first extension portion of the circuit board which covers the base-side air inlet includes a smaller width than that of the second extension portion.

9. The centrifugal fan according to claim 6, wherein a portion of the bend portion is arranged radially outward of an inner surface of the side wall of the housing.

10. The centrifugal fan according to claim 6, wherein the bend portion of the circuit board axially overlaps with a portion of the side wall of the housing.

11. The centrifugal fan according to claim 6, wherein the circuit board includes a hub corresponding portion arranged axially below the hub, a first extension portion arranged to extend radially outward from the hub corresponding portion, a second extension portion arranged to extend from the first extension portion and including the protruding portion, and a bend portion;

the first and second extension portions are joined to each other through the bend portion;

the base includes a base-side air inlet defined therein; and the bend portion of the circuit board axially overlaps with a portion of an edge of the base defining the base-side air inlet.

12. The centrifugal fan according to claim 6, wherein the circuit board further includes a wind tunnel corresponding portion; and the wind tunnel corresponding portion includes only a wiring pattern arranged thereon.

13. The centrifugal fan according to claim 6, wherein the base includes at least one hole defined in a portion thereof which is axially opposed to the circuit board; and one or more of the electronic components are arranged in the at least one hole.

14. The centrifugal fan according to claim 6, wherein at least a portion of an exterior of the side wall of the housing includes a circular arc shaped portion.

15. The centrifugal fan according to claim 6, wherein the hub has a diameter equal to or less than about 20 mm.

16. The centrifugal fan according to claim 6, wherein the base includes a base protruding portion arranged to protrude radially outward of the side wall; and at least a portion of the protruding portion of the circuit board is arranged on an upper surface of the base protruding portion.

17. The centrifugal fan according to claim 6, wherein the protruding portion includes a terminal portion to which a wire connected to an external power supply is connected.

18. A centrifugal fan comprising:

a hub substantially in the shape of a cylinder with a covered end centered on a central an impeller arranged radially outward of the hub;

a magnet attached to an inside of the hub;

an armature arranged radially opposite the magnet;

a bearing mechanism arranged to support the hub such that the hub is rotatable about the central axis with respect to the armature;

a bearing housing arranged to support the bearing mechanism;

a base arranged to support a lower end portion of the bearing housing;

a side wall including an air outlet defined therein, and arranged radially outward of the impeller to surround the impeller;

a cover including an air inlet defined therein, and arranged axially above the side wall;

a housing including the base, the side wall, and the cover;

a circuit board arranged on an upper surface of the base; and a control circuit portion including electronic components and arranged on the circuit board; wherein the circuit board includes a protruding portion arranged to protrude radially outward of an outer surface of the side wall of the housing;

at least one of the electronic components is arranged on the protruding portion;

the housing includes an annular flow path of air defined between an inner circumference of the side wall and an outer circumference of the impeller, the flow path including the air outlet arranged at a downstream end thereof; and the protruding portion is arranged at an area of an intersection of an outer surface of an upstream portion of the side wall and an outer surface of a midstream portion of the side wall.

19. The centrifugal fan according to claim 18, wherein the base includes a base protruding portion arranged to protrude radially outward of the side wall; and at least a portion of the protruding portion of the circuit board is arranged on an upper surface of the base protruding portion.

20. The centrifugal fan according to claim 18, wherein the protruding portion includes a terminal portion to which a wire connected to an external power supply is connected.

* * * * *